US008907813B2

(12) United States Patent
Cajigas Bringas et al.

(10) Patent No.: US 8,907,813 B2
(45) Date of Patent: Dec. 9, 2014

(54) METHOD FOR IMPROVING TRAFFIC SAFETY BY MEANS OF USING BEACONS

(75) Inventors: Guillermo Cajigas Bringas, Madrid (ES); José Carlos Sendra Alcina, Alcobendas (ES); Miguel Angel Touset Rios, Madrid (ES)

(73) Assignee: Vodafone Group PLC (GB)

( * ) Notice: Subject to any disclaimer, the term of this patent is extended or adjusted under 35 U.S.C. 154(b) by 1221 days.

(21) Appl. No.: 11/964,317

(22) Filed: Dec. 26, 2007

(65) Prior Publication Data

US 2008/0291007 A1 Nov. 27, 2008

(30) Foreign Application Priority Data

Dec. 28, 2006 (ES) ..... 200603302

(51) Int. Cl.

| | |
|---|---|
| ***G08G 1/09*** | (2006.01) |
| ***G08G 1/0967*** | (2006.01) |
| ***G08G 1/16*** | (2006.01) |
| ***G08G 1/052*** | (2006.01) |

(52) U.S. Cl.

CPC .... *G08G 1/096783* (2013.01); *G08G 1/096725* (2013.01); *G08G 1/164* (2013.01); *G08G 1/052* (2013.01)

USPC ..... 340/905; 340/539.1; 340/901; 701/300; 701/301; 701/302

(58) Field of Classification Search

USPC ..... 340/901, 905, 945, 983, 825, 502, 505, 340/928, 936, 993, 426.11, 9, 995.1, 340/539.13, 435–436; 701/9, 19, 213, 701/300–302

See application file for complete search history.

(56) References Cited

U.S. PATENT DOCUMENTS

| | | | | |
|---|---|---|---|---|
| 5,278,554 | A * | 1/1994 | Marton | 340/910 |
| 5,289,183 | A * | 2/1994 | Hassett et al. | 340/905 |
| 5,396,243 | A | 3/1995 | Jalink et al. | |
| 5,508,917 | A | 4/1996 | Siegle et al. | |
| 5,627,510 | A * | 5/1997 | Yuan | 340/435 |
| 5,675,518 | A * | 10/1997 | Kuroda et al. | 702/97 |
| 6,515,596 | B2 * | 2/2003 | Awada | 340/905 |

(Continued)

FOREIGN PATENT DOCUMENTS

| | | |
|---|---|---|
| FR | 2849251 | 6/2004 |
| GB | 2 358 509 | 7/2001 |
| WO | WO 03/096128 | 11/2003 |

OTHER PUBLICATIONS

U.S. Official Action in U.S. Appl. No. 12/027,676 mailed Jan. 7, 2010.

(Continued)

*Primary Examiner* — Brian Zimmerman
*Assistant Examiner* — An T Nguyen
(74) *Attorney, Agent, or Firm* — Merchant & Gould P.C.

(57) ABSTRACT

A traffic accident prevention service provides a method for improving traffic safety by using beacons. Each vehicle participating in the traffic accident prevention service includes a system for determining the speed of the vehicle, and a terminal connected to the system that has access to a wireless access network. Positioning beacons are located at different points of the road network and communicate via radio with the vehicles circulating close to them. The network warns the terminal of the safety parameters by knowing the position of the vehicle when it passes close to a beacon so that the driver can take appropriate actions.

5 Claims, 2 Drawing Sheets

(56) References Cited

U.S. PATENT DOCUMENTS

| | | | | |
|---|---|---|---|---|
| 6,720,889 | B2 * | 4/2004 | Yamaki et al. | 340/933 |
| 6,756,915 | B2 * | 6/2004 | Choi | 340/928 |
| 6,961,555 | B1 * | 11/2005 | Philyaw | 455/403 |
| 7,142,977 | B2 * | 11/2006 | Knuuttila et al. | 701/117 |
| 7,180,415 | B2 | 2/2007 | Bankert et al. | |
| 7,642,897 | B2 * | 1/2010 | Karabinis | 340/10.3 |
| 2002/0126023 | A1 | 9/2002 | Awada | |
| 2002/0186146 | A1 | 12/2002 | Mikhaylenko et al. | |
| 2003/0052797 | A1 * | 3/2003 | Rock et al. | 340/936 |
| 2004/0130463 | A1 * | 7/2004 | Bloomquist et al. | 340/907 |
| 2004/0233045 | A1 * | 11/2004 | Mays | 340/425.5 |
| 2005/0280552 | A1 | 12/2005 | DiPiazza | |
| 2006/0055561 | A1 * | 3/2006 | Kamali et al. | 340/936 |
| 2006/0071790 | A1 * | 4/2006 | Duron et al. | 340/572.1 |
| 2006/0220905 | A1 * | 10/2006 | Hovestadt | 340/901 |
| 2006/0289216 | A1 * | 12/2006 | Kato | 180/169 |
| 2007/0143001 | A1 * | 6/2007 | Park et al. | 701/117 |
| 2007/0285280 | A1 * | 12/2007 | Robinson et al. | 340/928 |

OTHER PUBLICATIONS

Spanish Search Report from ES 2 326 057 mailed Sep. 14, 2009 (1 page).

* cited by examiner

METHOD FOR IMPROVING TRAFFIC SAFETY BY MEANS OF USING BEACONS

FIELD OF THE INVENTION

The present invention relates to a method for preventing traffic accidents using a terminal with access to the mobile telephony network. By knowing the position of the vehicle by means of using beacons located at different points of the road network, the network warns the terminal of the safety parameters (maximum speed allowed, safety distance to the vehicle in front of it) at the point of the road network in which the vehicle is circulating. The terminal warns the driver of said safety parameters so that he or she can take the appropriate actions.

BACKGROUND OF THE INVENTION

Today the safety of vehicles circulating on the road is based on the drivers observing road signs as well as the recommendations provided by the competent organization through lighted panels situated on the road. In recent studies, it has been determined that speeding is one of the most common causes of traffic accidents and that an average speed reduction of 1 Km/h could reduce the total number of accidents by 3%. For this purpose, initiatives such as that of the driver's license point system are being carried out in different countries.

The present invention consists of a method for preventing traffic accidents by means of informing drivers of dynamic up-to-date information regarding safety on the road (speed limit, safety distance) according to climate considerations, congestion level of the road or blind spots where it is necessary to take maximum precautions. The solution can be integrated as an added value to commercial GPS navigation systems.

SUMMARY OF THE INVENTION

The present invention relates to a method for preventing traffic accidents, in its two alternative solutions.

In both solutions each vehicle circulating on the road network and participating in the Traffic Accident Prevention by Beacons TAPB service that said method provides has a terminal TE (for example, a mobile telephone with an installed application) that can access a wireless access network (for example, a mobile telephony network). The method in both alternative solutions has positioning beacons located at different points of the road network, which beacons transmit by radio their identifier $ID_B$ and the TAPB service identifier $ID_{TAPB}$ they provide.

First of all, it is necessary to subscribe to the TAPB service. For that purpose the terminal TE of the vehicle sends a request to the wireless access network to subscribe to said TAPB service, sending the following data with said request: the TAPB service identifier being requested, and optionally the number of points that the driver of the vehicle has in the event that the country in which the vehicle is located uses a driver's license point system. The wireless access network checks the subscription validation of the terminal TE, storing data received in the previous request and optionally confirming to the terminal TE its subscription to the TAPB service.

Subsequently, the wireless access network sends the terminal TE a temporary identifier $ID_{TE}$ of the terminal TE and optionally an update of the number of points the driver of the vehicle has and generic safety parameters $SP_{RNs}$ that the vehicle must observe at the point of the road network in which the vehicle is currently located (for example, in the event that its position can be estimated by the cell identifier "cell-id" in which the terminal TE is located, in the event that it is a mobile telephone, for example). Once this data is received, the terminal TE is placed in listen mode to receive information from the positioning beacons in the communication channel used by said beacons to communicate with the vehicles using the TAPB service. Once a message broadcast by a positioning beacon has been received, the terminal TE checks that the service provided by said beacon corresponds with the TAPB service, in which case the terminal TE sends to the wireless access network the identifier $ID_B$ of the beacon, its identifier $ID_{TE}$, and optionally safety parameters $SP_{MEAs}$ (such as for example the speed of the vehicle obtained by the means of determining the speed of the vehicle) of the vehicle measured therein. In the event that the terminal TE does not send said safety parameters $SP_{MEAs}$, the wireless access network calculates the safety parameters $SP_{MEAs}$ of the vehicle from the register times of the different data sent by the terminal TE to the wireless access network.

The wireless access network then optionally stores the data received, and sends to the terminal TE safety parameters $SP_{RNs}$ that the vehicle must observe at the point of the road network in which the vehicle is currently located (such as for example the speed allowed for said vehicle at the point of the road network in which it is located), and optionally an update of the number of points. The terminal TE communicates the current $SP_{RNs}$ to at least one of the occupants of the vehicle, normally to the driver of the vehicle, and/or to an external system in charge of automatically adjusting the speed of the vehicle. In the event that $SP_{MEA}>SP_{RN}$, for any of the safety parameters that are considered, the terminal TE warns of said situation so that the vehicle observes the $SP_{RNs}$.

The vehicle circulating in the road network and subscribed to the Traffic Accident Prevention by Beacons TAPB service provided by said method can additionally have means of determining the speed of the vehicle, connected to a terminal TE, the latter having access to the information provided by said means.

The safety parameters $SP_{MEAs}$ will normally be the speed of the vehicle, either measured by the vehicle itself through the means of determining the speed of the vehicle, or calculated by the wireless access network. The safety parameters $SP_{RN}$ will in this case be the speed allowed for said vehicle at the point of the road network in which it is located.

The vehicle subscribed to the TAPB service can in turn have means of detecting the distance $D_S$ to the vehicle in front of it. In this case, the safety parameters $SP_{MEAs}$ would be the speed of the vehicle and the distance $D_S$, whereas the safety parameters $SP_{RNs}$ would be the speed allowed for said vehicle at the point of the road network in which it is located and the safety distance that it must maintain with the vehicle in front of it at said point of the road.

When the safety parameters $SP_{MEAs}$ of the vehicle are measured therein and in the event that $SP_{MEA}>SP_{RN}$ is met in a predetermined number of times, the terminal TE sends a message to the wireless access network to communicate the violation of the established safety parameters. However, when the safety parameters $SP_{MEAs}$ of the vehicle are calculated by the network and in the event that $SP_{MEA}>SP_{RN}$ is met in a predetermined number of times, the wireless access network will send a message to the terminal TE to communicate the violation of the established safety parameters and/or a fine for the violation committed.

BRIEF DESCRIPTION OF THE DRAWINGS

To better understand the invention, an embodiment of the invention will be briefly described below as a non-limiting and illustrative example thereof. To that end, reference is made to the attached drawings, in which.

DETAILED DESCRIPTION OF THE PREFERRED EMBODIMENT(S)

Figure 1:
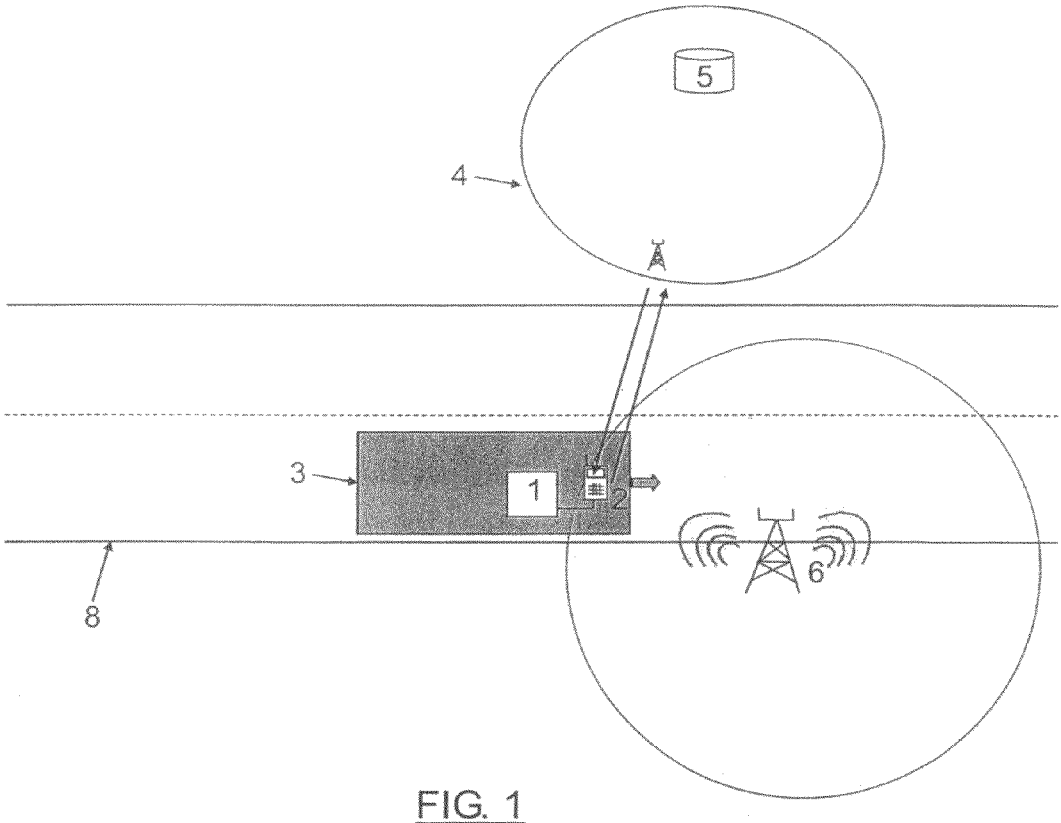
FIG. 1 shows the interaction of the terminal TE, connected to means of determining the speed of the vehicle, with the wireless access network.
Figure 2:
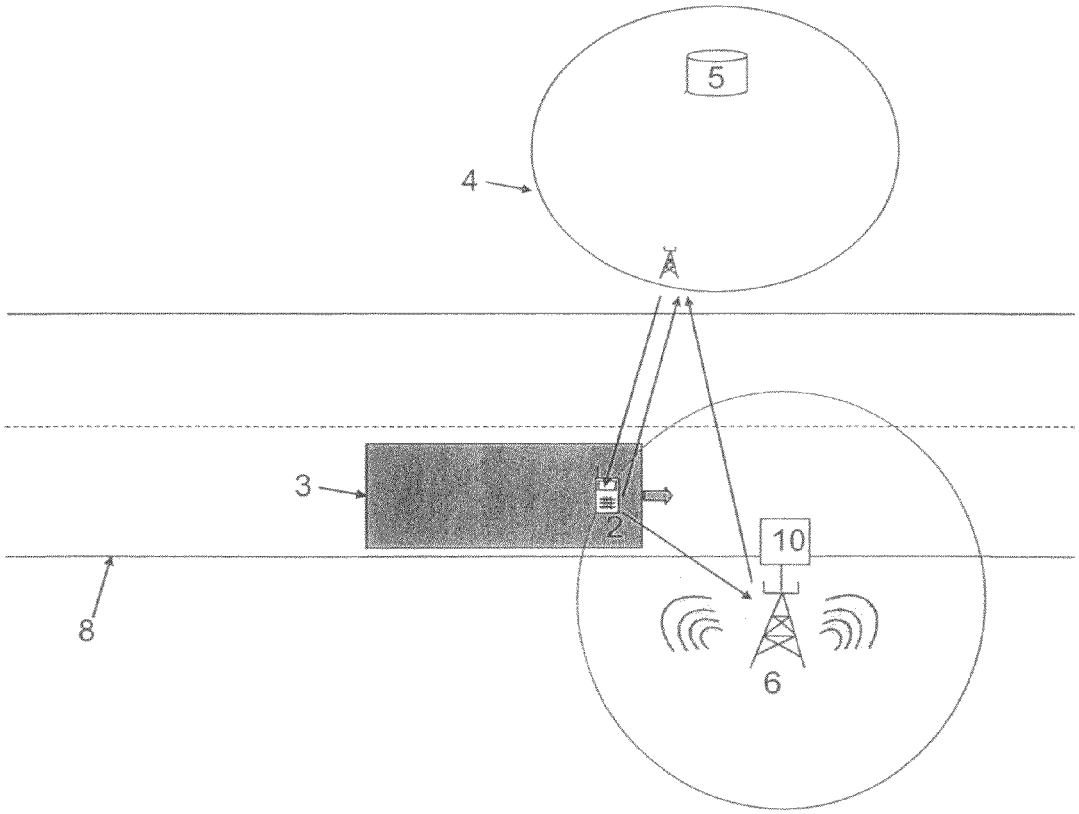
FIG. 2 shows an alternative solution in which the vehicle does not have means of determining the speed.

As shown in FIG. 1, a preferred embodiment of the method object of the invention is based on the availability of means 1 of determining the speed of the vehicle (a speedometer, for example) connected to a terminal TE 2, such as for example a mobile telephone of the driver of vehicle 3, which the terminal TE 2 has a client application installed and has access to the information provided by said means 1. The method uses positioning beacons 6 located on the roads and/or mobile beacons 6 (the latter normally being equipped with means of determining their position) using any type of wireless technology, normally short-range technology such as RFID. The beacons 6 emit in their environment in broadcast mode, or they can be activated by means of a presence sensor of the vehicle so they are not always emitting, their identifier $ID_B$ and the service identifier $ID_{TAPB}$ that they provide. The manner of implementing it is the following:

Terminal TE 2 subscribes to the service. To that end, it sends a request to a wireless access network 4 responsible for managing the traffic accident prevention TAPB service, as is done for example in the presence service defined by 3GPP for UMTS networks, although the solution would not be restricted to this type of networks. The parameters that are included in the request are: the service identifier, which will be called TAPB (Traffic Accident Prevention by Beacons) and optionally the number of points that the driver of the vehicle has (if the country in which the vehicle is located has a driver's license point system).

In response to this request, the wireless access network 4 will optionally store the previous data in a database 5 and/or check the subscription validation of the terminal TE, confirm its subscription to the TAPB service and send:

associated to the subscription, an identifier $ID_{TE}$ thereof to TE 2;

optionally, an update in the number of points if that number sent by TE 2 is greater than the number registered in the network or if the user has been able to recover points.

TE 2 will be placed in listen mode such that it will be dedicated to listening to the information emitted by the beacons 6. In the event that the beacon 6 transmits through RFID, the terminal TE 2 will listen in the frequency referred for this service.

TE 2 measures its current safety parameters $SP_{MEAs}$ (normally speed and safety distance) and for example registers its maximum values in a time period to be configured. This process can be carried out continuously or periodically. In this case, speed should be measured by an external sensor (e.g. the speedometer 1 of the vehicle itself).

Upon listening to the message broadcast by a beacon 6, TE 2 checks the service identifier it provides. If it coincides with that of the TAPB prevention service, $ID_{TAPB}$, TE 2 will send to the network 4 its identifier $ID_{TE}$, the identifier $ID_B$ of the beacon, and optionally the last measurement of its safety parameters $SP_{MEAs}$ (the current and maximum speed and safety distance, measured for example by means of a proximity sensor located at the front part of the vehicle, in a certain time period). If there were several nearby beacons 6 broadcasting, the one with the most power received would always be used and is usually the one closest to the vehicle. In any case, an attempt should be made to prevent this with a suitable planning of their locations, especially because it could provide erroneous data if there is another road very close by. If the beacon is mobile, such as the one located in a police car, it will be the priority beacon due to reception power or because the identifier $ID_B$ it broadcasts indicates that it has a higher priority. Therefore, the $ID_B$ can have a structure useful for giving priorities. The network 4 could also be made to temporarily disable or change the information associated to the fixed beacons 6 close to the mobile beacon of the police with the information of the latter. To determine the circulating direction of the vehicle, the terminal TE 2 can store the identifiers $ID_B$ of the beacons 6. The $ID_B$ of the previous beacon 6 stored in the terminal TE 2 will be used to determine its circulating direction. Another simpler option is that TE 2 sends to the network 4 a list of the beacons 6 it detects and the network 4 with the $ID_B$ of the previous beacon or beacons stored in its database 5 will determine the circulating direction and, together with information of a map, provide TE 2 with the safety parameters $SP_{RNs}$ that the vehicle 3 must observes at the point of the road network 8 in which it is currently located. In this case, the network 4 will fill the database 5 with the $ID_B$ of the beacon 6 chosen by it.

Then the network 4 optionally stores the information received in the database 5 and includes it, for example, in a table with columns ($ID_B$, current speed) as information for later use, as it indicates to the network 4 the congestion condition of the road at the point in which the beacon is located. The network 4 calculates the safety parameters $SP_{RNs}$ for this vehicle 3 according to the points it provided when it subscribed to the service and will send them to TE 2.

The TE 2 shows the received $SP_{RNs}$ to the user. The proposed interface is a voice interface, for which a Text-Voice converter in TE 2 or the addition in the previous response of network 4 of an audio file such as "We inform you that on the road in which you are circulating, for your safety, a maximum speed of 80 Km/h must be observed and a safety distance of 60 meters with the vehicle in front of you must be maintained" will be required.

TE 2 will continue measuring its current safety parameters $SP_{MEAs}$ (speed and safety distance) and will compare with them those previously indicated by the network 4 ($SP_{RNs}$). In the event that $SP_{MEA}<SP_{RN}$, nothing happens. If $SP_{MEA}>SP_{RN}$ (for example, if the maximum speed for the driver's license points it has is exceeded), TE 2 will warn the driver by means of a voice interface, for example. If the values are exceeded after a certain number of times (consecutive or not, in accordance with what is determined), a message can be sent to the network 4 to subsequently fine the driver, for example, and a warning that the driver has been fined is sent to him or her.

If the network 4 detects that TE 2 is inactive for a time to be defined, TE 2 must subscribe again (thus, the number of driver's license points is always up-to-date).

There is another alternative method for traffic accident prevention by beacons 6. As in the method described until now, a terminal TE 2 with access to the wireless access network 4 is needed. But in this case it is not necessary for the vehicle 3 to have means 1 of determining the speed of the vehicle 3. The TAPB service has positioning beacons 6 located at different points of the road network 8, preferably provided with means 10 of determining the speed of the vehicles 3 passing through the points of the road network 8 in which said beacons 6 are located, said beacons 6 transmitting by radio their identifier $ID_B$, the TAPB service identifier $ID_{TAPB}$ that they provide and optionally a time mark if the beacons have a common time base.

This method comprises the following steps for each vehicle 3 participating in the TAPB service:

Terminal TE 2 of the vehicle 3 sends a request to the wireless access network 4 to subscribe to the TAPB service, sending with said request the TAPB service identifier being requested and optionally the number of points that the driver of the vehicle 3 has in the event that the country in which the vehicle 3 is located uses a driver's license point system.

The wireless access network 4 optionally checks the subscription validation of the terminal TE 2.

The wireless access network 4 sends to the terminal TE 2 a temporary identifier $ID_{TE}$ of the terminal TE and optionally an update of the number of points that the driver of the vehicle 3 has.

Terminal TE 2 is placed in listen mode, to receive information from the positioning beacons 6, in the communication channel used by said beacons 6 to communicate with the vehicles 3 using the TAPB service.

Once a message broadcast by a positioning beacon 6 has been received, the terminal TE 2 checks that the service provided by said beacon 6 corresponds to the TAPB service, in which case the terminal TE 2 sends to the positioning beacon 6 its identifier $ID_{TE}$, and optionally the identifier $ID_B$ of the previous beacon (useful for obtaining the circulating direction of the vehicle 3) and, if the beacons have a common time base, the time mark of the previous beacon 6 (to calculate the average speed of the vehicle 3) with which the vehicle 3 has communicated, in the event that the terminal TE 2 stores the identifiers $ID_B$ and the time marks of the beacons 6 through which it passes. TE 2 would further store the $ID_B$ of the current beacon 6 and the time mark it has listened to for the purpose of sending it to the next beacon when it listens to its broadcasting message.

The beacon verifies the identifier $ID_B$ of its predecessor (the previous beacon anterior through which the vehicle has passed) and if it is correct, it will then process the message sent by TE 2, otherwise it will discard it. This is useful for eliminating the problems of a TE 2 being able to listen to several beacons. In the case that it is correct, there are two possibilities:

1. The beacon measures safety parameters $SP_{MEAs}$ of the vehicle (speed and safety distance, for example) with the available equipment (e.g. a radar) or with optional values of the time marks between two consecutive beacons, if the beacons have a common time base and the beacons know the distance between them. The time mark of the current beacon is known by the beacon itself because it coincides with that of the last broadcasting message it has sent; and the time mark of the previous beacon is that sent by TE 2. The beacon 6 sends to the wireless access network 4 the identifier $ID_{TE}$, its identifier $ID_B$ and optionally said $SP_{MEAs}$.
2. If the beacons cannot calculate the $SP_{MEAs}$ or in the event that the beacon 6 does not send said safety parameters $SP_{MEAs}$, the wireless access network 4 calculates the safety parameters $SP_{MEAs}$ of the vehicle 3 based on the register times of the different data sent by the beacon 6 to the network 4. The beacons would then be limited to sending $ID_{TE}$ and $ID_B$ to the network 4 and such network returns to the user the $SP_{RNs}$ for the user and would itself calculate the (average) speed based on the current speed and on a previous register in the database. The network 4, through its register database 5, will know the entry time therein of a previous value ($ID_B$ of the previous beacon). With the register times in the database 5 of the $ID_B$ of the current beacon and the $ID_B$ of the previous beacon through which the vehicle has passed, and knowing the position of the beacons, the network 4 can estimate the circulating speed of the vehicle 3.

The wireless access network 4 sends to the terminal TE 2 safety parameters $SP_{RNs}$ that the vehicle 3 must observe at the point of the road network 8 in which it is currently located and optionally an update of the number of points.

The terminal TE 2 communicates the current $SP_{RNs}$ to at least one of the following, to at least one of the occupants of the vehicle 3 and/or to an external system responsible for controlling the speed of the vehicle.

In the event that the wireless access network 4 detects that $SP_{MEA}>SP_{RN}$ for any of the safety parameters that are considered, the network 4 warns the terminal TE 2 of said situation so that the vehicle observes the $SP_{RNs}$. In the event that $SP_{MEA}>SP_{RN}$ is met in a predetermined number of times, the wireless access network 4 can send a message to the terminal TE 2 to communicate the violation of the established safety parameters and/or a fine for the violation committed.

The beacon 6 can have means of detecting the distance $D_S$ between the vehicle 3 and the vehicle in front of it, in which case $SP_{MEAs}$ are the speed of the vehicle 3 and the distance $D_S$, whereas $SP_{RNs}$ is the speed allowed for said vehicle 3 at the point of the road network 8 in which it is located and the safety distance that it must maintain with the vehicle in front of it at said point of the road 8. Therefore, as in the first claimed method, the safety parameters can be the maximum speed and/or the safety distance.

In the event that TE 2 remains inactive for a time to be defined, TE 2 must subscribe again.

The invention claimed is:

1. A method for improving traffic safety using beacons located at different points of a road network, the method comprising:

wirelessly transmitting from each beacon a message including a respective identifier ($ID_B$);

receiving, at a terminal installed in a vehicle circulating in the road network, the message from a given one of the beacons including its identifier ($ID_B$);

once the terminal receives the message from the given one of the beacons, transmitting from the terminal to a mobile telephony network an identifier ($ID_{TE}$) of the terminal and the identifier ($ID_B$) received from the given one of the beacons;

in the mobile telephony network, calculating an average speed of the vehicle based on:

an entry time in a register database of the identifier ($ID_B$) of a current beacon and an entry time of the identifier ($ID_B$) of a previous beacon which the vehicle has passed; and known distances between the current beacon and the previous beacons;

in the mobile telephony network, determining a speed limit allowed for the vehicle at a point of the road network in which the vehicle is located;

from the mobile telephony network, sending a speed limit message to the terminal in dependence upon the determined speed limit;

once the terminal receives the message from the given one of the beacons, determining a distance ($D_s$) between the vehicle and a second vehicle located in front of the vehicle and transmitting the distance ($D_s$) to the mobile telephony network;

in the mobile telephony network, determining a safety distance the vehicle has to maintain from vehicles ahead of the vehicle at said point of the road network;

from the mobile telephony network, sending the safety distance to the terminal; and upon determining that the safety distance exceeds the distance ($D_s$), transmitting a distance warning message to the terminal indicating that the safety distance exceeds the distance ($D_s$).

2. The method of claim 1, wherein sending the speed limit message to the terminal further comprises, upon determination that the speed of the vehicle exceeds the speed limit, the mobile telephony network sending a warning message to the terminal indicating that the speed of the vehicle exceeds the speed limit.

3. The method of claim 1, wherein the speed limit message is transmitted to at least one occupant of the vehicle.

4. The method of claim 1, wherein the speed limit message is transmitted to an external system in charge of automatically adjusting the speed of the vehicle.

5. The method of claim 1, wherein the message from a given one of the beacons includes information including the identifier ($I_{DB}$), and wherein determining the speed limit allowed for the vehicle further comprises determining the speed limit allowed for the vehicle using at least some of the information received from the given one of the terminals.

* * * * *